US005181826A

United States Patent [19]

Rock

[11] Patent Number: 5,181,826

[45] Date of Patent: Jan. 26, 1993

[54] ATTENUATING SHROUD SUPPORT

[75] Inventor: Peter J. Rock, Byfield, Mass.

[73] Assignee: General Electric Company

[21] Appl. No.: 617,244

[22] Filed: Nov. 23, 1990

[51] Int. Cl.[5] ..... F01D 25/26

[52] U.S. Cl. ..... 415/173.1; 415/171.1

[58] Field of Search ..... 415/114, 115, 116, 117, 415/134, 135, 139, 173.1, 173.3, 173.6

[56] References Cited

U.S. PATENT DOCUMENTS

| | | | |
|---|---|---|---|
| 2,445,661 | 7/1948 | Constant et al. | 60/41 |
| 3,043,564 | 7/1962 | Small, Jr. | 415/137 |
| 3,583,824 | 6/1971 | Smuland et al. | 415/117 |
| 3,703,808 | 11/1972 | Stearns | 415/115 |
| 3,807,891 | 4/1974 | McDow et al. | 415/116 |
| 3,980,411 | 9/1976 | Crow | 415/115 |
| 4,050,843 | 9/1977 | Needham et al. | 415/116 |
| 4,101,242 | 7/1978 | Coplin et al. | 415/134 |
| 4,127,357 | 11/1978 | Patterson | 415/116 |
| 4,435,123 | 3/1984 | Levine | 415/115 |
| 4,522,557 | 6/1985 | Bouiller et al. | 415/116 |
| 4,553,901 | 11/1985 | Laurello | 415/138 |
| 4,676,715 | 6/1987 | Imbault et al. | 415/116 |
| 4,759,687 | 7/1988 | Miraucourt et al. | 415/127 |
| 4,863,345 | 9/1989 | Thompson et al. | 415/174.1 |

FOREIGN PATENT DOCUMENTS

| | | | |
|---|---|---|---|
| 975879 | 12/1948 | France | 415/136 |
| 2293594 | 2/1976 | France . | |
| 2121885 | 1/1984 | United Kingdom . | |

*Primary Examiner*—Edward K. Look
*Assistant Examiner*—Michael S. Lee

[57] ABSTRACT

A shroud support for a gas turbine engine includes a mounting flange mountable to a casing, a hanger for supporting a turbine shroud, and an annular coupling joining the mounting flange to the hanger. The coupling includes a set of circumferentially spaced apertures defining a set of beams therebetween, with the beams being sized and configured for attenuating radial distortion from the mounting flange transmitted to the hanger. In a preferred embodiment of the invention, the coupling includes a frustum which includes the apertures and beams.

10 Claims, 4 Drawing Sheets

ATTENUATING SHROUD SUPPORT

The U.S. Government has rights in this invention pursuant to Contract No. DAAE 07-84-C-R083 awarded by the Department of the Army.

Technical Field

The present invention relates generally to gas turbine engine turbine shrouds, and, more specifically, to a turbine shroud support.

Background Art

A gas turbine engine includes one or more turbines each having a plurality of circumferentially spaced rotor blades between which is channeled combustion gas. Disposed radially outwardly of the turbine blades is an annular turbine shroud for providing a seal for minimizing leakage of the combustion gas around the blades. It is desirable to have a clearance between the turbine shroud and the rotor blades which is as small as possible for minimizing leakage therethrough, but which is also large enough for preventing undesirable rubs between the rotor blades and the shroud. The blade tip clearance is a primary factor in the efficiency and performance of the turbine, with the leakage of combustion gases therethrough adversely affecting turbine performance. Accordingly, gas turbine engines are conventionally designed for minimizing the blade tip clearances.

Circumferential variations in blade tip clearance can increase a turbine's average blade tip clearance during operation which in turn affects turbine performance. Circumferential clearance variations may be developed during engine operation by mounting loads and temperature gradients. A turbine shroud is typically supported by an engine casing, and loads and temperature variation in the casing can create circumferentially varying radial distortion of the casing which is transmitted through the shroud support to the shroud, and thereby creating circumferential variations in blade tip clearances between the shroud and rotor blades.

In an exemplary gas turbine engine having a recuperator which heats compressor discharge air which is then channeled through a casing to a combustor, the heated air creates circumferential variations in radial distortion of the casing. For example, the recuperated air in the exemplary engine, is channeled through the casing through two conduits spaced approximately 180° apart. These two conduits provide two relatively hot regions in the casing which expand greater than the portions of the casing therebetween. This results in what is conventionally known as a two nodal diameter distortion pattern which drives the casing out-of-round. The two nodal diameter distortion pattern is basically an ellipse having its major axis greater than the diameter of the original circular casing, and its minor axis less than the diameter of the original casing. Accordingly, four nodes of no displacement are defined at the intersection of the elliptical distorted casing relative to the circular undistorted casing. The two nodal distortion pattern in turn is transmitted through the shroud support to the shroud which affects the blade tip clearances. In this exemplary engine, radial distortion of the casing is amplified about 20% through the shroud support. Accordingly, turbine performance is further degraded due to the amplified radial distortion as applied to the turbine shroud.

OBJECTS OF THE INVENTION

Accordingly, one object of the present invention is to provide a new and improved turbine shroud support.

Another object of the present invention is to provide a turbine shroud support effective for attenuating radial distortion transmitted therethrough.

Another object of the present invention is to provide a shroud support effective for accommodating circumferential variations in temperature distribution of the casing from which the support is suspended.

Another object of the present invention is to provide a turbine shroud support effective for attenuating circumferential variations in radial distortion transmitted therethrough.

DISCLOSURE OF INVENTION

A shroud support for a gas turbine engine includes a mounting flange mountable to a casing, a hanger for supporting a turbine shroud, and an annular coupling joining the mounting flange to the hanger. The coupling includes a plurality of circumferentially spaced apertures defining a plurality of beams therebetween, with the beams being sized and configured for attenuating radial distortion from the mounting flange transmitted to the hanger. In a preferred embodiment of the invention, the coupling includes a frustum which includes the apertures and beams.

BRIEF DESCRIPTION OF DRAWINGS

The novel features believed characteristic of the invention are set forth and differentiated in the claims. The invention, in accordance with preferred and exemplary embodiments, together with further objects and advantages thereof, is more particularly described in the following detailed description taken in conjunction with the accompanying drawings in which:

MODE(S) FOR CARRYING OUT THE INVENTION

Figure 1:
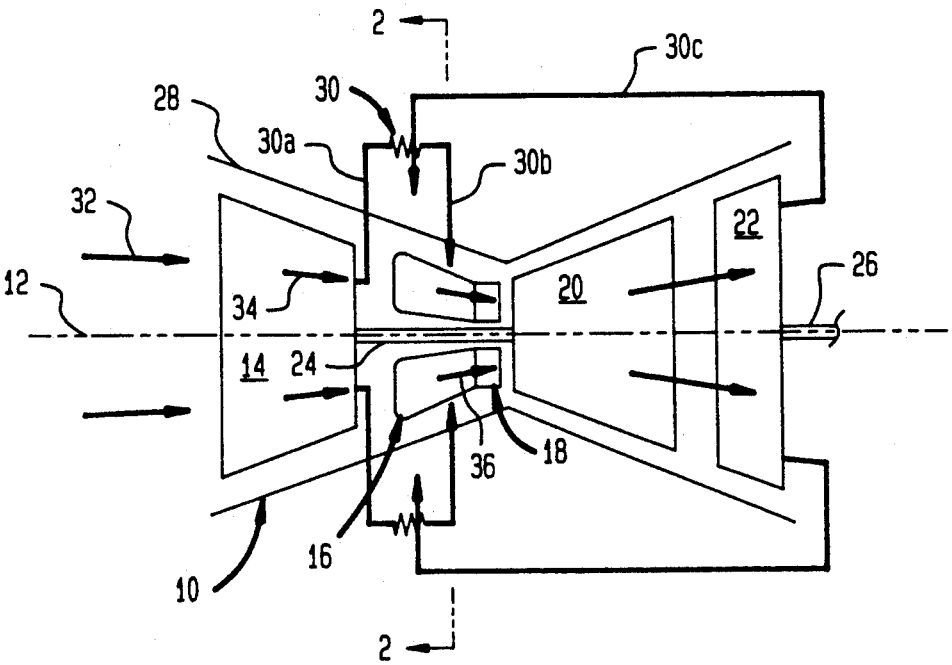
FIG. 1 is a longitudinal, schematic sectional view of an exemplary recuperated gas turbine engine.

Illustrated in FIG. 1 is a schematic representation of a gas turbine engine 10. The engine 10 includes in serial flow communication and coaxially disposed about an engine axial centerline axis 12, a conventional compressor 14, annular combustor 16, high pressure (HP) turbine nozzle 18, high pressure turbine (HPT) 20, and low pressure turbine (LPT) 22. A conventional HP shaft 24 fixedly joins the compressor 14 to the HPT 20, and a conventional low pressure (LP) shaft 26 extends from the LPT 22 for powering a load (not shown).

The engine 10 further includes an annular casing 28 which extends over the compressor 14 and downstream therefrom and over the LPT 22. A conventional recuperator, or heat exchanger, 30 is disposed between the compressor 14 and the LPT 22 outside the casing 28.

In conventional operation of the engine 10, ambient air 32 is received by the compressor 14 and compressed for generating compressed airflow 34. The compressed airflow 34 is conventionally channeled through suitable conduits 30*a* through the recuperator 30 wherein it is further heated and then channeled through suitable conduits 30*b* through the casing 28 and adjacent to the combustor 16. The heated compressed airflow 34, designated recuperator airflow 34*b*, is then conventionally mixed with fuel and ignited in the combustor 16 for generating combustion gases 36 which are channeled through the nozzle 18 and into the HPT 20. The HPT 20 extracts energy from the combustion gases 36 for driving the compressor 14 through the HP shaft 24, and then the combustion gases 36 are channeled to the LPT 22. The LPT 22 in turn further extracts energy from the combustion gases 36 for driving the load (not shown) joined to the LP shaft 26. The recuperator 30 is conventionally joined to the LPT 22 by conduits 30*c* for channeling a portion of the combustion gases 36 from the LPT 22 into the recuperator 30 for heating the compressed airflow 34 flowing therethrough.

Figure 2:
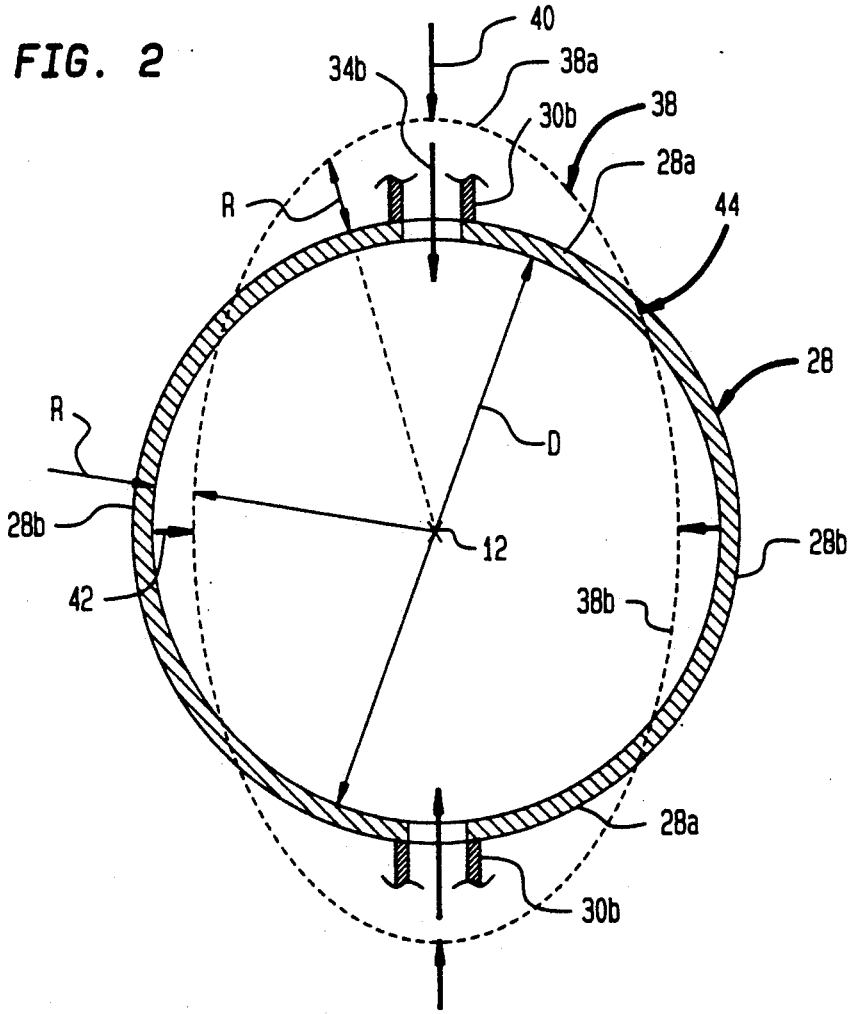
FIG. 2 is a transverse section through the engine illustrated in FIG. 1 taken along line 2—2 and illustrating an undistorted casing with a distorted casing superimposed thereon in dashed line.

Illustrated in FIG. 2 is a transverse sectional view of the casing 28 surrounding the combustor 16 showing two recuperator conduits 30*b* joined to the casing 28 at angular positions 180° apart. The casing 28 is initially round or circular having a nominal diameter D. During operation of the engine 10, the recuperator airflow 34*b* is channeled through the recuperator conduits 30*b* and through the casing 28. Since the hot recuperated airflow 34*b* is channeled through the casing 28 through the two 180° spaced apart conduits 30*b*, the casing 28 adjacent to the conduits 30*b* designated 28*a* experiences a higher temperature than the casing 28 disposed generally 90° therefrom and designated 28*b*.

Accordingly, the casing 28 will experience a radial distortion due to the circumferential variation in temperature thereof and will form a generally elliptical profile designated 38 and shown greatly exaggerated in dashed line in FIG. 2. The distorted casing profile 38 exhibits a generally two nodal diameter distortion pattern in the form of an ellipse wherein the ellipse major axis 40 is greater than the diameter D of the undistorted casing 28, and the ellipse minor axis 42 is less than the diameter D of the undistorted casing 28 resulting in four nodes 44 of no radial displacement of the distorted casing 38. As illustrated in FIG. 2, the distorted casing profile 38 is greater than the undistorted casing diameter D between the two nodes 44 straddling the recuperator conduits 30*b* at the top and bottom of the casing 28, which are designated as the casing apogee 38*a*. And, between the nodes 44 straddling the casing side portions 28*b*, the casing 28 experiences distortion radially inwardly relative to the undistorted casing 28, which are designated as the casing perigee 38*b*.

Figure 3:
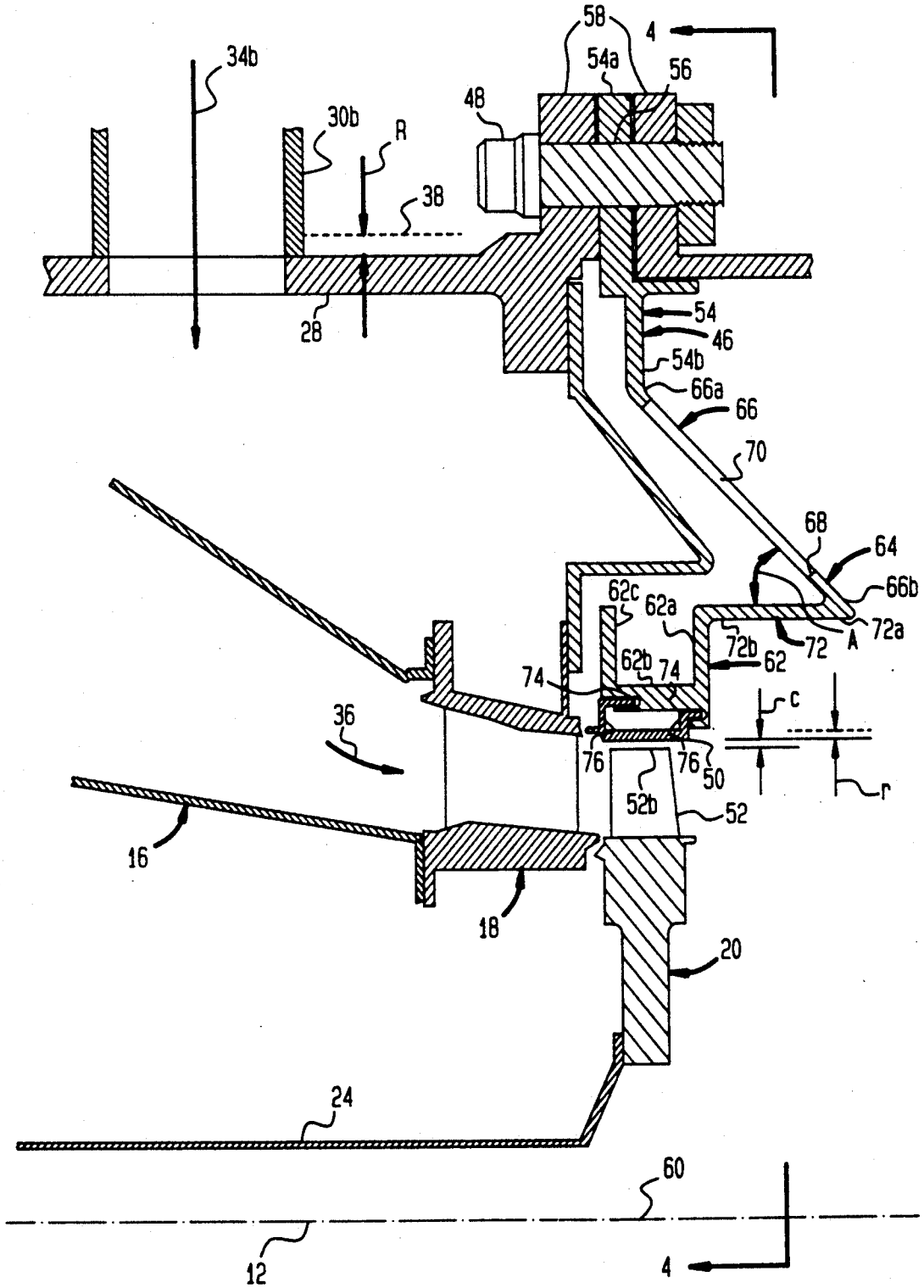
FIG. 3 is an enlarged longitudinal sectional view of a turbine shroud support in accordance with one embodiment of the present invention along with structures adjacent thereto.

The radial distortion of the casing 28 due to the recuperated airflow 34*b* affects turbine blade tip clearance since the turbine shrouds are supported by the casing 28. More specifically, and as illustrated in FIG. 3, the engine 10 further includes in accordance with one embodiment of the present invention, a turbine shroud support 46 conventionally fixedly supported to the casing 28 surrounding the combustor 16 by a plurality of circumferentially spaced bolts 48. A conventional turbine shroud 50, in the exemplary form of a plurality of circumferentially spaced shrouds segments, is conventionally joined to the shroud support 46 and predeterminedly radially spaced from a plurality of rotor blades 52 of a first stage of the HPT 20.

Each of the blades 52 includes a blade tip 52*b* spaced radially inwardly from the shroud 50 to define a blade tip clearance C. Since the shroud 50 is joined to the casing 28 by the shroud support 46, the distorted casing profile 38 will in turn affect the radial position of the shroud support 46 which in turn affects the magnitude of the blade tip clearance C. As illustrated in FIG. 2, the distorted casing profile 38 is represented by the relative radial displacement R of the casing 28 from its circumferentially undistorted round profile. The radial displacement, or distortion, R has positive values indicating an increased diameter at both of the casing apogee portions 38*a* adjacent to the recuperator conduits 30*b*. The radial distortion R decreases in value to zero at the two nodes 44 straddling the conduits 30*b*, and then has negative values indicating a decreased diameter at both the casing perigee portions 38*b* adjacent to the casing side portions 28*b* between adjacent nodes 44. The maximum negative value, or reduction in diameter of the casing 28, occurs at the 90° positions from the conduits 30*b* along the minor axis 42 of the profile 38. As a result of this circumferential variation in radial distortion of the casing 28, the blade tip clearance C illustrated in FIG. 3 will decrease at the casing side portions 28*b* thus possibly leading to undesirable rubs between the blade tips 52*b* and the shroud 50, as well as undesirably increase along the casing portions 28*a* at the recuperator conduits 30*b*.

Figure 4:
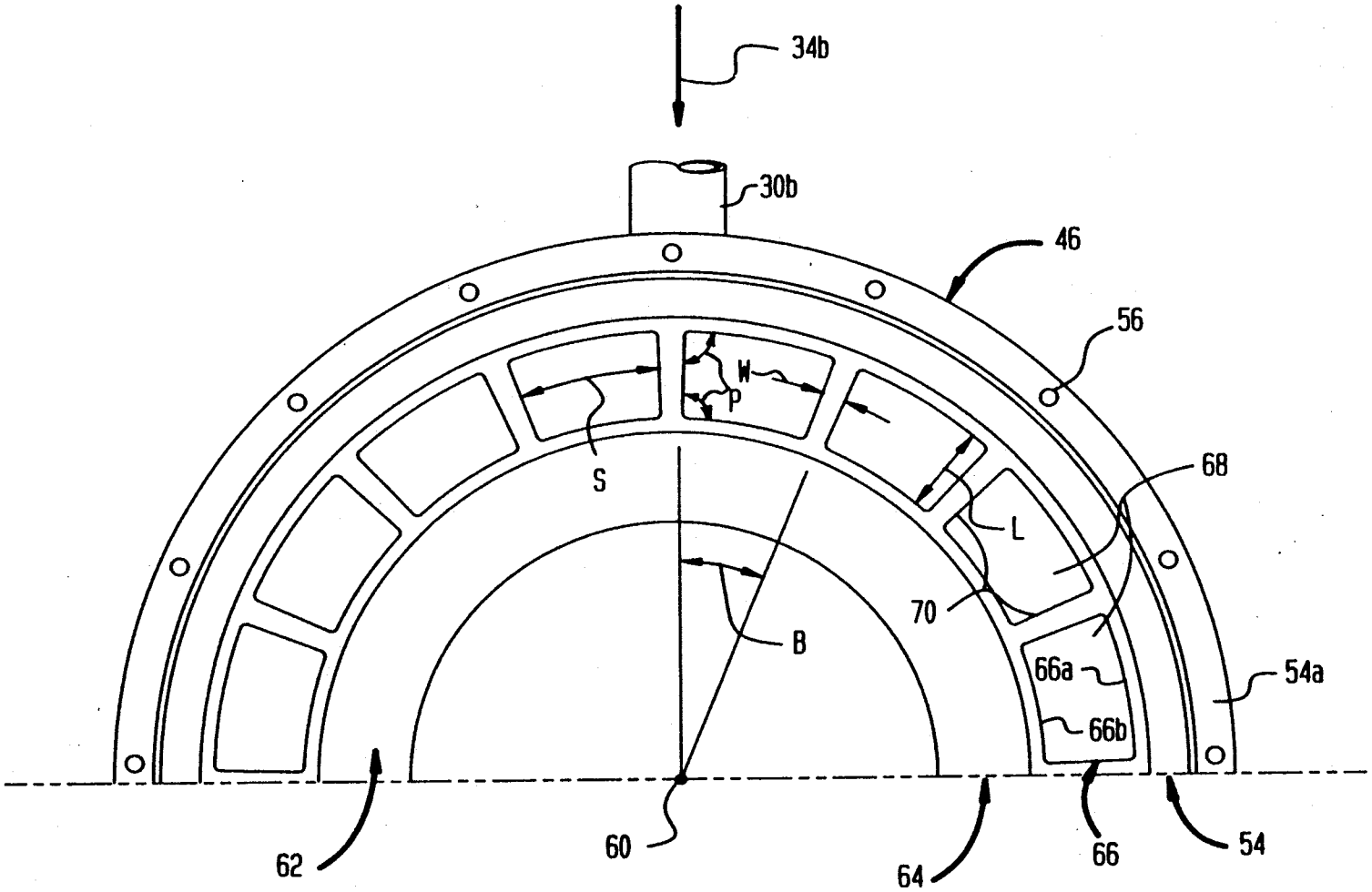
FIG. 4 is an upstream facing end view of the turbine shroud support illustrated in FIG. 3 taken along line 4—4.
Figure 5:
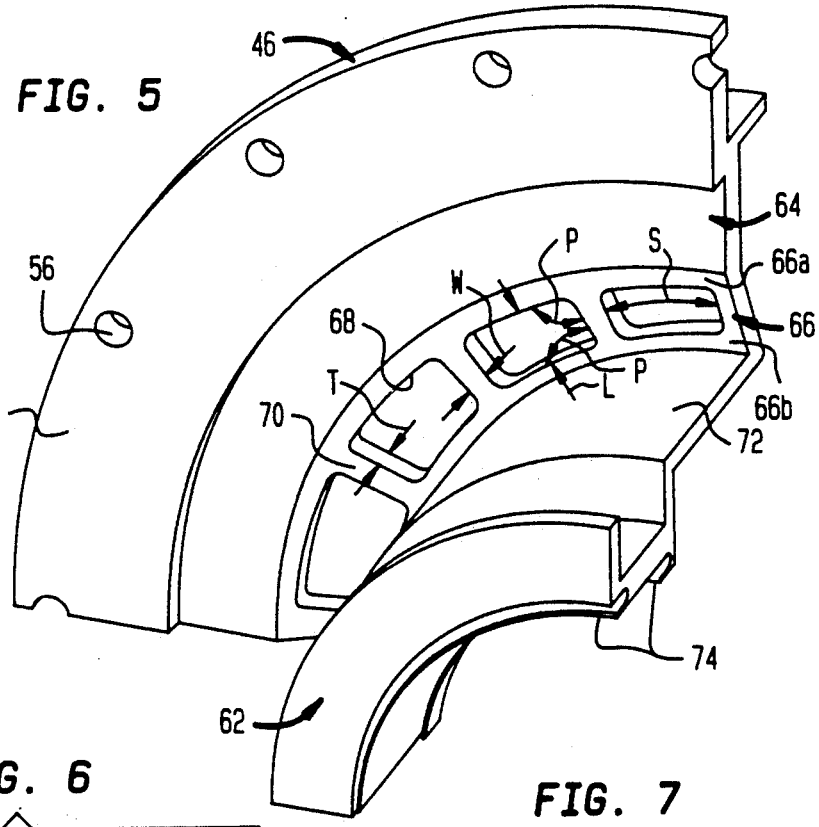
FIG. 5 is a downstream facing perspective view of the turbine shroud support illustrated in FIGS. 3 and 4.

As illustrated in FIGS. 3-5, the turbine shroud support 46 in accordance with an exemplary embodiment of the present invention includes an annular radially outwardly extending mounting flange 54 having a radially outer end 54*a* conventionally fixedly mounted to the casing 28. The radially outer end 54*a* includes a plurality of circumferentially spaced holes 56 through which the bolts 48 are disposed for clamping the mounting flange 54 between a pair of casing flanges 58 formed integrally with the casing 28. The shroud support 46 further includes a longitudinal centerline axis 60 which is preferably coaxial with the engine centerline axis 12, about which is disposed coaxially an annular hanger 62 spaced radially inwardly from the mounting flange 54 for supporting the turbine shroud 50.

In accordance with one embodiment of the present invention, a 360°, annular coupling 64 fixedly joins the mounting flange 54 to the hanger 62. The coupling 64 includes an annular hollow frustum 66, or frustoconical member, which includes a plurality of circumferentially spaced apertures 68 defining a plurality of circumferentially spaced beams 70 therebetween. The beams 70 are preferably sized and configured for reducing or attenuating the radial distortion r transmitted to the hanger 62 from the mounting flange 54. Since the mounting flange 54 is directly connected to the casing 28, the radial distortion R from the casing 28 is directly transmitted to the mounting flange 54 and, in accordance with the present invention, the radial distortion R is attenuated through the shroud support 46 for reducing the transmitted radial distortion r experienced in the hanger 62 which directly affects the blade tip clearance C.

As illustrated in FIGS. 3-5, the frustum 66 includes an annular radially outer base 66*a* which is fixedly joined to an annular radially inner end 54*b* of the mounting flange 54, for example by being formed integrally therewith, and an annular top 66*b* joined as described hereinbelow to the hanger 62. Since the frustum 66 is a frustoconical member, its base 66*a* has a larger diameter than its top 66*b*. The frustum 66 has an acute cone angle A greater than 0° and less than 90° relative to the shroud support centerline axis 60.

In the preferred embodiment of the present invention, the coupling 64 further includes a tubular cylinder 72 as illustrated more clearly in FIGS. 3 and 5, disposed coaxially with the centerline axis 60 and radially between the frustum 66 and the hanger 62. The cylinder 72 has a proximal end 72*a* fixedly joined to the frustum top 66*b*, and is preferably integral therewith, and also includes a distal end 72*b* fixedly joined to the hanger 62, and is preferably integral therewith.

As more readily illustrated in FIGS. 4 and 5, the apertures 68 extend between the frustum base 66*a* and top 66*b* to define the beams 70 also extending from the base 66*a* to the top 66*b*. The beams 70 are preferably equidistantly spaced from each other at a circumferential distance S, and equiangularly spaced from each other at an angle B. The beams 70 are preferably disposed, or oriented perpendicularly to the frustum base 66*a* and top 66*b* at angles P of 90°, and extend radially outwardly relative to the centerline axis 60. Each of the beams 70 has a length L, width W, and thickness T, and the quantity, spacing (S,B), orientation, length L, width W, and thickness T of the beams 70 are preselected for providing a predetermined flexibility of the frustum 66 for attenuating the radial distortion r transmitted to the hanger 62.

Figure 6:
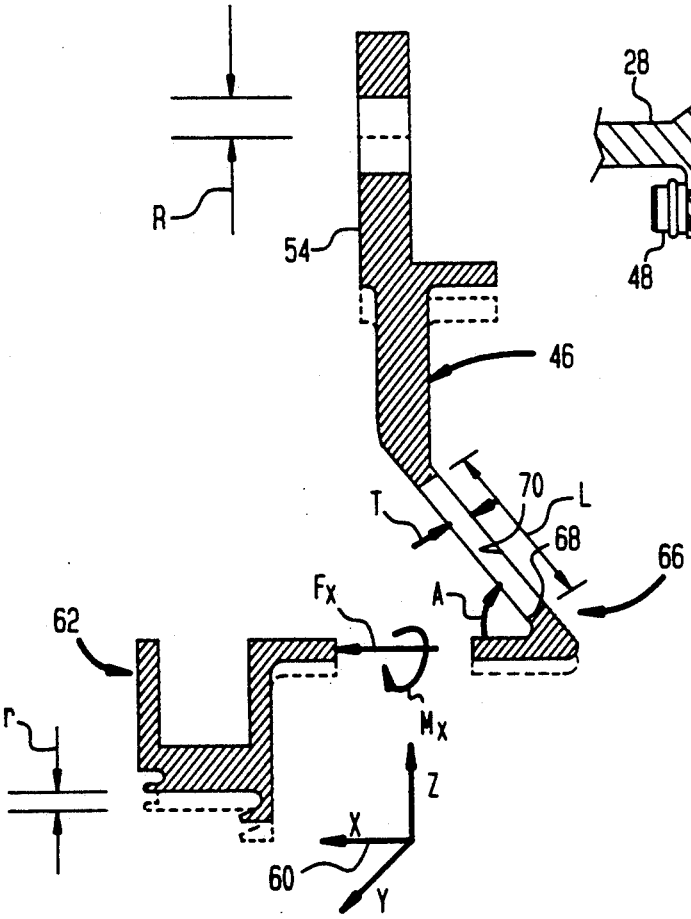
FIG. 6 is a longitudinal sectional view of the turbine shroud support illustrated in FIG. 3 shown in free-body form illustrating internal axial forces and moments applied to the hanger thereof.

More specifically, the inventor has discovered that in a shroud support such as the support 46 including a frustum 66, the radial distortion R is primarily transmitted to the hanger 62 by the internal axial forces and axial moments therein. Referring to FIG. 6, a free-body diagram of a longitudinal section of the shroud support 46 is illustrated. An orthogonal X, Y, Z coordinate system is also illustrated wherein the X axis is the shroud support centerline axis 60, the Z axis is the radial axis, and the Y axis is a tangential axis. The internal axial force $F_x$ and axial moment $M_x$ applied to the hanger 62 from the cylinder 72 based on the application of the radial distortion R are also illustrated.

Since the shroud support 46 is a 360° annular member, the interaction between the radially extending mounting flange 54 and hanger 62 through the frustum 66 and cylinder 72 is relatively complex. In order to investigate the radial distortion, a reference shroud support such as that illustrated in FIG. 6 without the apertures 68 in the frustum 66 was built and tested by pulling apart radially outwardly at two points 180° apart on the mounting flange 54 and measuring the effect on the hanger 62. The application of a 10 mil (0.25 mm) total two nodal distortion pattern applied to the mounting flange 54 produced a 12 mil (0.30 mm) runout at the shroud hanger 62. The test indicated about a 20% amplification in radial distortion, or out-of-roundness, applied to the mounting flange 54 and measured at the hanger 62. In other words, the radial runout of the mounting flange 54 was increased a given amount while the radial runout of the hanger 62 increased about 20% greater than the runout of the flange 54. Runout is a conventional known indication of the amount of "out-of-roundness" of the hanger 62 and represents the difference between the maximum and minimum diameters of the hanger 62 at the shroud 50.

An analytical investigation of the reaction loads throughout the reference shroud support without the apertures 68 identified the transmitted internal axial force $F_x$ and axial moment $M_x$ applied to the hanger 62 as the major loads accounting for the hanger's hangers out-of-roundness and amplification of the applied distortion, and confirmed the test results. Of course, the axial force $F_x$ and axial moment $M_x$ shown in FIG. 6 vary circumferentially around the hanger 62 in this three-dimensional structure. The inventor has discovered that by providing the apertures 68 and the beams 70 in the frustum 66, the radial distortion r transmitted to the hanger 62 from the radial distortion R applied to the mounting flange 54 may be substantially attenuated, and in one embodiment was reduced by a factor of about 3. More specifically, the same 10 mil (0.25 mm) distortion pattern imposed on the reference shroud support was also analytically imposed on the shroud support 46 including the apertures 68 and the beams 70 and resulted in about a 3 mil (0.08 mm) runout at the shroud hanger 62.

From the pull test and analytical investigation, it has been determined that by introducing a predetermined flexibility into the otherwise substantially stiff frustum 66, the transmitted radial distortion r in the hanger 62 can be substantially reduced, or attenuated, from the magnitude of the applied radial distortion R. Although FIG. 2 discloses the undistorted casing 28 and the radially distorted casing 38 due to a two nodal distortion pattern, (R), substantially identical patterns also occur at the hanger 62 with the magnitude of the transmitted radial distortion being r instead of R. The present invention is effective for not only reducing the magnitude of the transmitted radial distortion r to less than the applied radial distortion R, but also reducing the circumferential variation thereof, as measured by the runout of the hanger 62. Without the apertures 68 and beams 70 in the frustum 66, the circumferential variation in radial distortion r would have generally the elliptical pattern shown at 38 in FIG. 2. With the apertures 68 and beams 70, the circumferential variation in radial distortion r will have a less pronounced elliptical pattern between the ellipse designated 38 in FIG. 2 and the circle designated 28. In other words, the runout is decreased. Accordingly, the reduction in the transmitted radial distortion r reduces the circumferential variation in blade tip clearance C shown in FIG. 3.

The amount of flexibility in the frustum 66 provided by the apertures 68 and the beams 70 may be determined for each particular design application by varying the size and configuration of the beams 70 as described above, as well as by varying the cone angle A of the frustum 66. For example, in a preferred embodiment of the present invention, the frustum cone angle A was about 53°, and sixteen beams 70 were equiangularly spaced around the circumference of the frustum 66. It is preferable to make the frustum 66 as flexible as possible for reducing the axial force $F_x$ and the axial moment $M_x$ transmitted to the hanger 62 which is limited by, for example, the vibratory response of the frustum 66 and the maximum internal stresses generated therein. Depending upon particular design applications, an effective reduction in the transmitted radial distortion r may be obtained without experiencing undesirable resonance conditions of the frustum 66. As the frustum 66, or beams 70, become more and more flexible, the internal stresses therein adjacent to the frustum base 66*a* can increase for analyzed loading conditions, and such increased internal stresses are limited by conventional practice for obtaining acceptable life of the frustum 66 during operation in a gas turbine engine environment.

However, although the internal stresses in the beams 70 adjacent to the frustum base 66*a* can increase due to the flexibility of the beams 70, the internal stresses at the frustum top 66*b* at the junction with the cylinder 72 decrease. This is an additional advantage of the present invention since the hanger 62 and cylinder 72 may be formed of a low coefficient of thermal expansion alloy with the mounting flange 54 and frustum 66 being formed of a relatively high coefficient of thermal expansion alloy for additionally and conventionally controlling the blade tip clearance C. Since the joint between the high and low coefficients of expansion components experiences increased stress due to thermal growth mismatch between those components, the radial distortion attenuating shroud support 46 reduces the joint stresses, for example by about 41% in an exemplary embodiment, by reducing the transmitted forces through the frustum 66. Reduced stress levels, of course, result in a longer useful part life.

Referring again to FIG. 3, the hanger 62 preferably includes an annular aft rail 62*a* fixedly joined to the cylinder distal end 72*b*, by being formed integrally therewith, an annular base 62*b* for supporting the shroud 50, and an annular forward rail 62*c* fixedly joined to the base 62*b*, by being formed integrally therewith, and being spaced generally parallel to the aft rail 62*a* for forming a generally U-shaped hanger 62. The hanger base 62*b* includes a pair of axially spaced slots 74 which receive in close sliding fit a pair of complementary hooks 76 of the shroud 50 for conventionally mounting the shroud 50 to the hanger 62.

Figure 7:
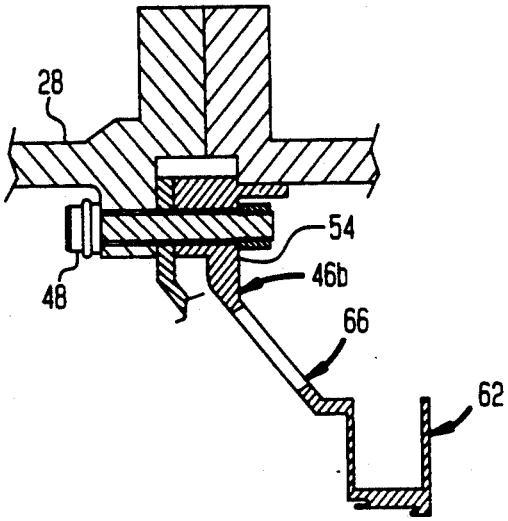
FIG. 7 is a longitudinal sectional view of a turbine shroud support in accordance with another embodiment of the present invention.

Illustrated in FIG. 7 is an alternate embodiment of the turbine shroud support designated 46*b*. The shroud support 46*b* is identical to the shroud support 46 illustrated in FIGS. 3–6 except that the hanger 62 is directly connected to the frustum 66 without the use of the cylinder 72, and the mounting flange 54 is located radially inside the casing 28. Of course, these changes may be accomplished separately or together, and the casing 28 is conventionally joined together above the flange 54. It is believed that an even further attenuation in the transmitted radial distortion r may be obtained by mounting the hanger 62 directly to the frustum 66 instead of to the cylinder 72.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

More specifically, and for example only, various configurations of the frustum 66 including various configurations and orientations of the beams 70 therein may be utilized for attenuating the transmitted radial distortion r. In the preferred embodiment of the invention, the frustum 66 is effective for reducing the internal axial forces $F_x$ and axial moments $M_x$ for attenuating the radial distortion r transmitted to the hanger 62. Of course, various types of hangers 62 may also be utilized for supporting various types of shrouds 50 depending upon particular design applications.

Accordingly, what is desired to be secured by Letters Patent of the United States is the invention as defined and differentiated in the following claims:

I claim:

1. A turbine shroud support comprising:

an annular mounting flange having a radially outer end fixedly mountable to a casing, and a radially inner end;

an annular hanger spaced radially inwardly from said mounting flange for supporting a turbine shroud;

an annular coupling fixedly joining said mounting flange to said hanger, and including a plurality of circumferentially spaced apertures defining a plurality of beams therebetween, said beams being sized and configured for reducing axial force and axial moment transmitted from said mounting flange to said hanger for attenuating radial distortion transmitted to said hanger from said mounting flange.

2. A shroud support according to claim 1 wherein said coupling includes a frustum having a base fixedly joined to said mounting flange, and a top joined to said hanger, and said apertures extend between said base and said top to define said beams extending from said base to said top.

3. A shroud support according to claim 2 wherein said beams are equiangularly spaced from each other.

4. A shroud support according to claim 3 wherein said frustum includes a centerline axis and said beams extend radially outwardly relatively to said frustum centerline axis and perpendicularly to said base.

5. A shroud support according to claim 2 wherein said beams each have a length, width, and thickness preselected for providing flexibility of said frustum for attenuating said transmitted radial distortion.

6. A shroud support according to claim 2 wherein said coupling further includes a tubular cylinder disposed coaxially between said frustum and said hanger, and having a proximal end fixedly joined to said frustum top, and a distal end fixedly joined to said hanger.

7. A shroud support according to claim 6 wherein said hanger includes an aft rail fixedly joined to said cylinder distal end, a base fixedly joined to said aft rail for supporting said shroud, and a forward rail fixedly joined to said base and spaced generally parallel to said aft rail.

8. A shroud support according to claim 7 wherein said frustum includes a centerline axis and said beams extend radially outwardly relative to said frustum centerline axis and perpendicularly to said base and said top, and equiangularly from each other.

9. A shroud support according to claim 8 wherein said beams each have a length, width, and thickness preselected for providing flexibility of said frustum for attenuating said transmitted radial distortion.

10. A shroud support according to claim 9 wherein said frustum has a cone angle relative to said frustum centerline axis of about 53°.

* * * * *